US011000091B1

(12) United States Patent
Kyle

(10) Patent No.: US 11,000,091 B1
(45) Date of Patent: May 11, 2021

(54) BIMODAL SHOE

(71) Applicant: Kentigern Kyle, Naples, FL (US)

(72) Inventor: Kentigern Kyle, Naples, FL (US)

( * ) Notice: Subject to any disclaimer, the term of this patent is extended or adjusted under 35 U.S.C. 154(b) by 0 days.

(21) Appl. No.: 16/120,899

(22) Filed: Sep. 4, 2018

Related U.S. Application Data

(60) Provisional application No. 62/694,484, filed on Jul. 6, 2018, provisional application No. 62/553,326, filed on Sep. 1, 2017.

(51) Int. Cl.

| | |
|---|---|
| ***A43B 11/00*** | (2006.01) |
| ***A43B 23/02*** | (2006.01) |
| ***A43B 3/12*** | (2006.01) |
| ***A43B 21/26*** | (2006.01) |
| ***A43B 13/14*** | (2006.01) |
| ***A43B 13/18*** | (2006.01) |

(52) U.S. Cl.
CPC ..... *A43B 11/00* (2013.01); *A43B 3/128* (2013.01); *A43B 13/141* (2013.01); *A43B 13/183* (2013.01); *A43B 21/26* (2013.01); *A43B 23/028* (2013.01)

(58) Field of Classification Search
CPC ..... A43B 11/00; A43B 11/02; A43B 3/128; A43B 13/141; A43B 13/183; A43B 21/26; A43B 21/30; A43B 21/32; A43B 23/028
See application file for complete search history.

(56) References Cited

U.S. PATENT DOCUMENTS

| | | | | |
|---|---|---|---|---|
| 2,736,110 | A | 2/1956 | Hardimon | |
| 2,920,402 | A | 1/1960 | Minera | |
| 3,039,207 | A * | 6/1962 | Harry Lincors | A43B 13/18 36/58.5 |
| 4,783,909 | A | 11/1988 | Van Doren et al. | |
| 5,127,170 | A | 7/1992 | Messina | |
| 5,481,814 | A * | 1/1996 | Spencer | A43B 7/00 36/103 |
| 6,594,921 | B2 | 7/2003 | Laio et al. | |
| 7,793,438 | B1 | 9/2010 | Busse et al. | |
| 8,065,819 | B2 | 11/2011 | Kaufman | |
| 8,225,534 | B2 * | 7/2012 | Mueller | A43B 13/16 36/76 R |
| 9,675,132 | B2 | 6/2017 | Marshall | |
| 10,602,802 | B2 * | 3/2020 | Hopkins | A43B 13/141 |
| 10,660,401 | B1 * | 5/2020 | Pratt | A43B 13/14 |
| 2005/0039348 | A1 | 2/2005 | Raluy et al. | |
| 2005/0076540 | A1 | 4/2005 | Su | |
| 2008/0168683 | A1 | 7/2008 | Keating | |
| 2011/0016751 | A1 | 1/2011 | Somerville | |
| 2014/0298687 | A1 * | 10/2014 | Flinterman | A43B 13/14 36/103 |

(Continued)

*Primary Examiner* — Ted Kavanaugh

(57) ABSTRACT

A bimodal shoe having a bimodal structure, the bimodal structure configured to selectively snap to at least one of a second position and a first position. The bimodal structure is a bendable structure that selectively snaps into the first position upon being subjected to a first bending force, and that selectively snaps into the second position upon being subjected to a second bending force, where the first bending force has an opposite direction to the second bending force. A downward force applied to a heel counter of the bimodal shoe while holding portions of the shoe forward from the bimodal structure stationary causes the bimodal structure to snap out of the second position.

3 Claims, 6 Drawing Sheets

(56) References Cited

U.S. PATENT DOCUMENTS

| | | | | |
|---|---|---|---|---|
| 2016/0058123 | A1* | 3/2016 | Peyton | A43B 13/183<br>36/25 R |
| 2018/0235314 | A1* | 8/2018 | Farage | A43B 23/0245 |
| 2018/0263332 | A1* | 9/2018 | Bruno | A43B 13/188 |

* cited by examiner

BIMODAL SHOE

CROSS-REFERENCE TO RELATED APPLICATION

This application claims the benefit of U.S. Provisional Patent Application Ser. No. 62/694,484, filed Jul. 6, 2018 and United States Provisional Patent Application Ser. No. 62/553,326, filed Sep. 1, 2017, which are incorporated herein in their entirety.

FIELD OF THE INVENTION

The present disclosure is generally directed to shoes, and more particularly to a bimodal shoe or sandal, or other foot related mechanical device, that allows a user to conveniently don and doff a shoe or device in fast or hands-free fashion.

BACKGROUND OF THE INVENTION

It is common for individuals to wear shoes, such as running shoes or tennis shoes. A shoe usually has a fastening arrangement that allows a user to fasten their shoe to their foot. For example, such fastening arrangements may include straps, shoe laces, or zippers.

However, existing shoes are problematic because their fastening arrangements are too complicated, unreliable, ugly, and take too much time to fasten shoes. For example, assuming a shoe lace is already threaded through a shoe, the shoe lace has to be pulled and tied in a doubly slipped reef knot formed by joining ends of the shoe lace. Straps with hook and loop fasteners are faster to secure than shoe laces, but straps are not durable and many consider them ugly. Zippers are uncomfortable to use and are known to break and come loose.

Other types of shoes have evolved that have no straps or fastening devices, and thus permit rapid donning, such as flip flops, sandals, or clogs. However, these shoe designs by lacking securement systems of the back heel often do not provide the necessary stability to the foot to permit safe running or active use. Further, these designs are often cited for causing numerous injuries and falls.

Other types of shoes have evolved that are rapidly donned that do have some kind of support provided to the back heel, such as shoes made of flexible material similar to pull-on water shoes; or shoes with flexible heel straps of varying designs; for example the commercial brand Crocs. However, these shoe designs require the dedicated use of hands, with the user required to sit or bend down to fasten them.

Other types of shoes have evolved that are designed to be quicker and easier to don on and off, with minimal use of hands, without sitting or bending down to fasten or unfasten the shoe. However, these designs utilize complicated and inefficient snaps, wheels, ratchets, magnets, mainsprings, pulleys, electric motors, common structures with loops and connection points, pivotally movable straps with support brackets, pivot mechanisms attaching the outer counter to the sole, and other designs that are neither convenient to use nor cost effective to produce.

Other types of shoes have evolved without the use of complicated mechanisms and make use of a bimodal spring, that attempt to provide a shoe that requires minimal use of hands, and without sitting or bending down to fasten or unfasten the shoe. However, these designs do not specify a working bimodal spring that can be activated during normal use as to make the design practical and useful by the end user, or, specify a machine stamped bimodal spring that does not have a dual directional pressure activation point that enables both donning on and off the shoe, or, specify other complicated bimodal spring devices that utilize large protruding mechanisms that are not able to be incorporated into conventional footwear or foot devices in aesthetically pleasing or consumer accepted fashion. Other types of shoes have evolved without the use of complicated mechanisms and make use of a bimodal spring, that attempt to provide a shoe that require minimal use of hands, and without sitting or bending down to fasten or unfasten the shoe. However, these designs fall into two categories: designs that do not specify a working bimodal spring that can be activated during normal use as to make the design practical and useful by the end user; or, specify a machine stamped bimodal spring that does not have a dual directional pressure activation point that enables both donning on and off the shoe.

Therefore there exists a need for an improved shoe that is quicker and easier to don and doff in comparison to existing shoe designs, with minimal use of hands, without sitting or bending down to fasten or unfasten the shoe, that permit the use of active motion such as running or active walking without possibility of injury or stumbling, have a functional bimodal spring mechanism activated by multiple pressure points that can be easily used by the consumer, are cost effective to produce, and can be incorporated into conventional footwear or foot devices in aesthetically pleasing or consumer accepted fashion.

SUMMARY OF THE INVENTION

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure. The invention as disclosed incorporates a multitude of concepts that some or all of which can combine to collectively solve the challenges as defined in the Summary of the Invention.

Disclosed is a bimodal shoe, defined as shoe device or other similar foot device that can incorporate the benefits of the designs defined below including but not restricted to structures such as shoes, boots, sandals, clogs, skis, snowboards, skates, skateboards, flippers, paddle board foot areas, or other similar structures, the bimodal shoe comprising, a bimodal structure, the bimodal structure configured to selectively snap to a second position and a first position, wherein the bimodal structure has incorporated convex and concave positions, either or both positions with stored kinetic potential (e.g. elastic potential energy), wherein the bimodal structure utilizes the tensile properties of materials shaped in spherical, curved, or semi-spherical forms, wherein the forms can be changed from one position to the other by directional force from multiple sides (e.g. lateral forces directed to a pressure point), wherein the directional force is applied to a pressure point causing the structure to change positions upon a threshold directional force being applied.

In one aspect, the bimodal structure can be activated to snap into the first position causing an opening of the bimodal shoe formed by the top line, collar or collar wall to change for receiving a foot in the bimodal shoe.

In another aspect, causing the bimodal structure to snap into the second position causes an opening of the bimodal shoe formed by the top line, collar, or collar wall to change for securing a foot received in the bimodal shoe.

In another aspect, causing the bimodal structure to snap into the first position causes a heel counter of the shoe to pivot.

In another aspect, causing the bimodal structure to snap into the first position causes a heel counter to deform.

In another aspect, the bimodal structure is a clasp, or three-point clasp, manufactured as a flat material configured to be forced into a form approaching to some degree a hollow hemisphere or ellipsoid, often with a single stamped congruence point, said clasp resembling a 3 point snap hair clip and its known mechanical properties.

In another aspect, the bimodal structure includes a semi-sphere, defined as a hollow hemisphere with a wide range of scalings in at least one of the second position and the first position, and variations of holes, slits, or deformations as to improve bimodal functionality.

In another aspect, the bimodal structure includes a dimple, defined as a hollow half-ellipsoid with a wide range of scalings.

In another aspect, the bimodal structure is curved in at least one of the second position and the first position.

In another aspect, the bimodal structure is concave in at least one of the second position and the first position In another aspect, the bimodal structure is concave in one of the second position and first position, and convex in another one of the second position and first position.

In another aspect, the bimodal structure is located at or in the sole of the bimodal shoe.

In another aspect, the bimodal structure is located at a heel counter of the bimodal shoe.

In another aspect, the bimodal structure is located at a sole of the bimodal shoe such that stepping in the shoe with a user's foot while the bimodal structure is in the first position causes the bimodal structure to snap into the second position.

In another aspect, the bimodal structure comprises at least one of, a clasp in the sole, a clasp in the heel counter, a flexible semi-spherical form in the sole, a flexible semi-spherical form in the heel counter, and a dimple in the sole.

In another aspect, mechanisms permit directional force to be applied in a hands free fashion to pressure points required to activate the bimodal structure comprised of, a heel counter based pivot system that changes downward pressure on a heel tab into upward pressure to a sole based bimodal structure at its activation pressure point, a rear sole or flared heel based system that changes downward pressure on the heel tab into pressure to the bimodal structure at its activation pressure point.

In another aspect, the bimodal structure of the heel counter variations contain two side arms or bands that separate and cause the heel notch and shoe opening to become larger for receiving a foot and vice-versa.

In another aspect, the bimodal shoe contains a back tab or shape that forms part of a lever, that by using the back sole and heel portion in connected fashion, creates a lever converting downward pressure on the tab or shape into upward pressure to the singular pressure point that can activate the bimodal structure.

In another aspect, the bimodal shoe contains a back sole area that rises upwards behind the heel counter, converting downward pressure on the back tab or shape into upward focused pressure to the singular pressure point that can activate the bimodal structure.

In another aspect, flexible areas of the body of the shoe or shoe-like structure traverse from a narrower portion of the shoe to a wider portion of the shoe, such that when the bimodal structure is activated the opening of the shoe is increased or decreased.

In another aspect, the heel counter variations may contain a separation between the bimodal structure forming the heel counter and the sole area below.

In another aspect, the shoe can incorporate one or a combination of bimodal structures depending on the desired functionality, design, and aesthetics of the bimodal shoe.

In another example, the bimodal structure utilizes the tensile properties of materials shaped in spherical, semi-spherical, and semispherical forms as seen in a 3 point clasp, wherein the form can be changed from concave to convex position by lateral directional force from at least two opposing sides and directions.

In another aspect, the bimodal structure comprises one of a clasp in the sole, a clasp in the sole extending out and forming a back heel tab, a clasp in the heel counter, a flexible semi-spherical form in the sole, a flexible semi-spherical form in the heel counter, and/or a semi-spherical dimple in the sole In another aspect, disclosed mechanisms permit directional force to be applied in a hands free fashion to the pressure points required to activate the bimodal structure, where the mechanisms are one or more of: a heel counter based pivot system that changes downward pressure on the heel tab into upward pressure to a heel based bimodal structure at its activation pressure point, or a sole based system that changes downward pressure on a heel tab into pressure to a sole based bimodal structure at its activation pressure point.

In another aspect, a heel counter variations includes two side arms that separate and cause the heel notch or shoe opening to become larger for receiving a foot and vice-versa when the bimodal structure moves to the first position.

In another aspect, the heel counter may contain a separation between the bimodal structure forming a heel counter and a sole area below.

In another aspect, the shoe can incorporate one or a combination of the bimodal structures mentioned above for improving the design, functionality, and aesthetics of the bimodal shoe.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIG. 2C' presents a rotated view of the bimodal structure of FIG. 2C, in accordance with aspects of the present disclosure;

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4A:
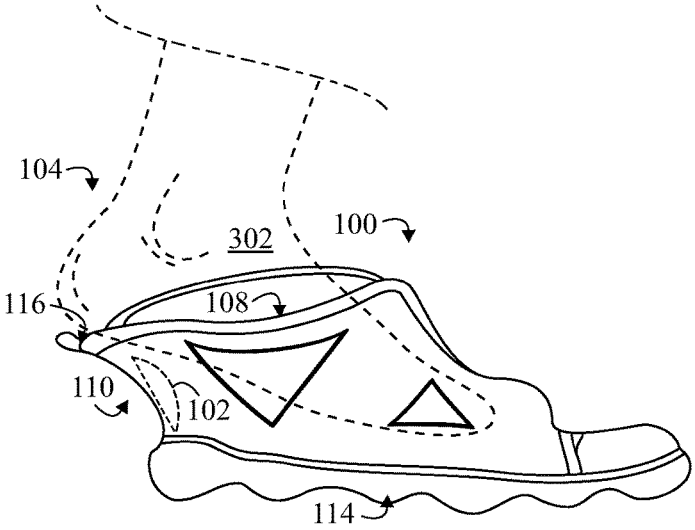
FIG. 4A presents a side view of an exemplary bimodal shoe including a bimodal spherical structure at heel counter of the bimodal shoe, where the shoe is being donned, in accordance with aspects of the present disclosure.
Figure 4E:
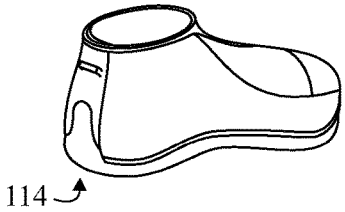
FIG. 4E presents a perspective view of a bimodal shoe, where a bimodal structure extends from a sole of the shoe into a heel counter of the shoe, in accordance with aspects of the present disclosure.
Figure 4F:
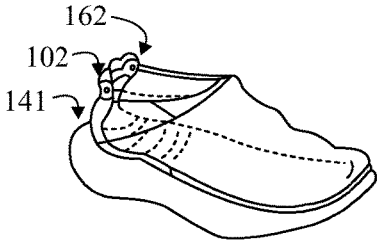
FIG. 4F presents a perspective view of a bimodal shoe having a back sole that rises upwards behind the heel counter, the back sole being configured to convert downward pressure on the back sole into focused pressure at the single pressure point that activates a bimodal structure, in accordance with aspects of the present disclosure.
Figure 4B:
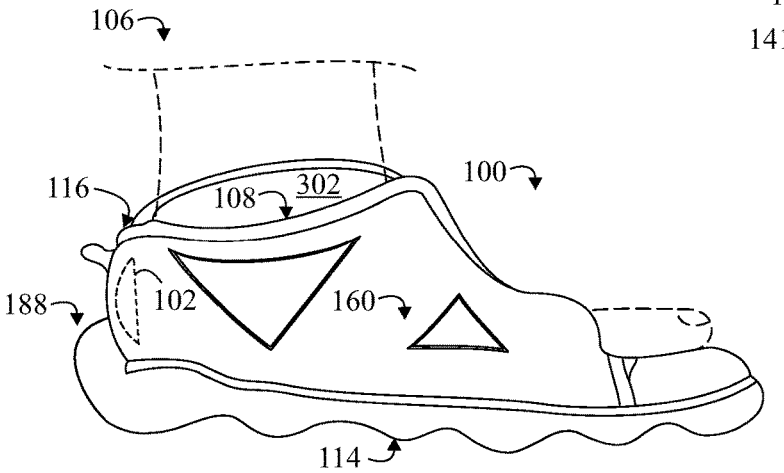
FIG. 4B presents a side view of the exemplary bimodal shoe of FIG. 4A, where the shoe has been donned, in accordance with aspects of the present disclosure.
Figure 4G:
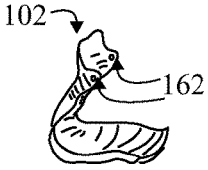
FIG. 4G presents a perspective view of a bimodal structure that is attachable to both a heel counter and a sole of a shoe, having arms that separate when moving between a first and second position, in accordance with aspects of the present disclosure.
Figure 4D:
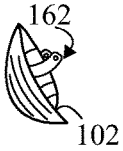
FIG. 4D presents a bimodal spherical structure separated from a heel counter of the bimodal shoe, in accordance with aspects of the present disclosure.

As shown throughout the figures, disclosed is a bimodal shoe 100. The bimodal shoe 100 may include a bimodal structure 102. The bimodal structure 102 may be configured to selectively snap to a first position 104 and a second position 106. The bimodal structure 102 may take any appropriate form such as a 3-point clasp, selectively invertible dimple, snap, a half hollow hemisphere, a half-cylinder, a torus, oval, half-ellipse, hollow half-ellipse, walnut shape, stadium arch, circle or similar shapes all of varying scalings. The bimodal structure may be an added element to the shoe or may be incorporated into the structure of the shoe itself. The bimodal structure may span between both a heel counter and a sole of a shoe. For example, FIG. 4G presents a perspective view of a bimodal structure that is attachable to both a heel counter and a sole of a shoe, having arms that separate when moving between a first and second position.

It is to be understood, that the bimodal shoe 100 may be embodied as a sandal or any appropriate footwear.

An opening 108 of the bimodal shoe 100 may open, expand, or separate, in response to the bimodal structure 102 snapping into the first position 104 starting from the second position 106. The opening 108 may close, contract, or come together in response to the bimodal structure 102 snapping into the second position 106 starting from the first position 104. Therefore, causing the bimodal structure 102 to snap into the first position 104 may cause the opening 108 of the bimodal shoe 100 to change for receiving a foot 302 in the bimodal shoe 100. Further, causing the bimodal structure 102 to snap into the second position 106 may cause an opening 108 of the bimodal shoe 100 to change (e.g. become smaller) for securing a foot 302 already received in the bimodal shoe 100. It is understood that numerous parts of the shoe 160, such as the shoe wall, sole, heel counter, top lines, quarter panel, tongue, midsole, or stitch seam made of material with or without flexible properties, will be deformed, pushed, pulled, tightened, stretched, constricted or otherwise change structure depending on the different states 104 or 106, and said shoe structures will aid in the securing or removal of the shoe to the foot 302, with the possible addition of strings, laces, straps, loops, belts, elastics, ribs, ropes, and other forms, and these variations of construction do not represent a unique utility, nor represent a distinction from the basic functionally derived from the bimodal shoe as described in this disclosure.

A wearer may press their foot 302 applying downward pressure into the bimodal shoe 100 when the bimodal structure 102 is in the first position 104 to cause the bimodal structure 102 to adopt or snap into the second position 106 and secure the wearer's foot 302 in the shoe by causing the opening 108 to secure the wearer's foot (e.g. grip the foot or ankle), hands-free.

Figure 2A:
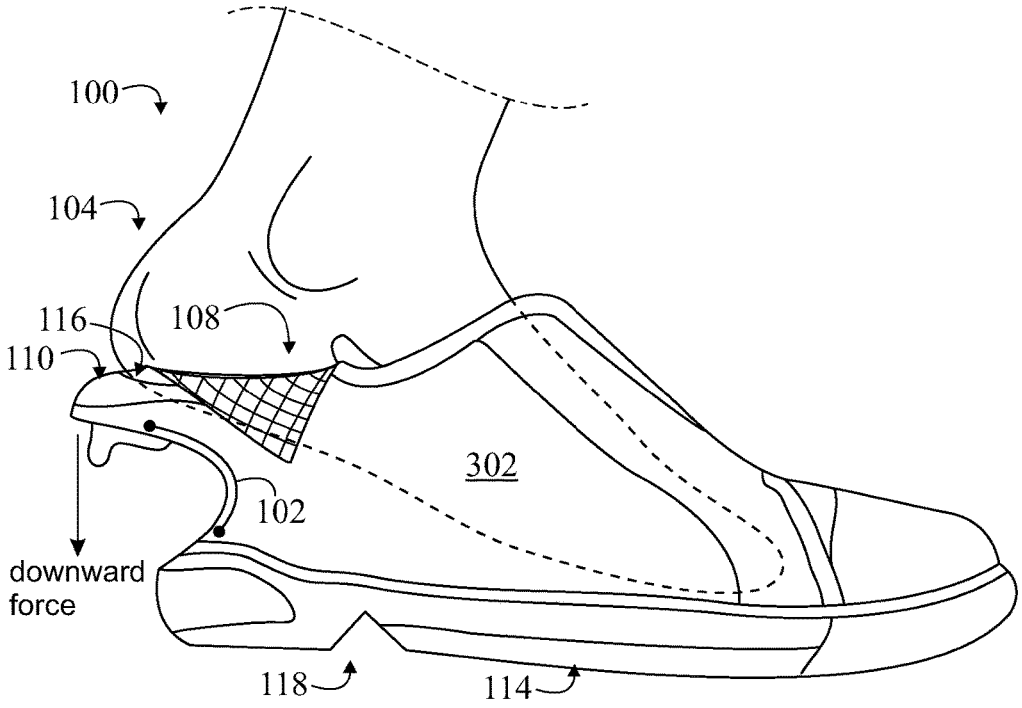
FIG. 2A presents a side view of an exemplary bimodal shoe including a bimodal clasp at a heel counter of the bimodal shoe, where the shoe is being donned, in accordance with aspects of the present disclosure.

The illustrations show various ways the opening responds to various configurations of the bimodal structure adopting the second position 106 and the first position 104, For example, the opening 108 may expand backwardly with respect to a front of the bimodal shoe 100. Likewise downward pressure causing the bimodal structure 102 to snap into the first position 104 may cause a heel counter 110 of the bimodal shoe 100 to pivot downward. As shown in FIGS. 2A, and 4A, causing the bimodal structure 102 to snap into the first position 104 may cause a heel counter 110 to deform, Therefore, to deform the opening 108, the heel counter 110 may pivot from or near a vicinity of the bimodal structure 102, or alternatively the heel counter 110 may deform, depending on where the bimodal structure 102 is located. It is to be understood that the bimodal structure could be configured to snap (e.g. to be held by its own structural properties) into only one of the first or second positions.

Figure 1A:
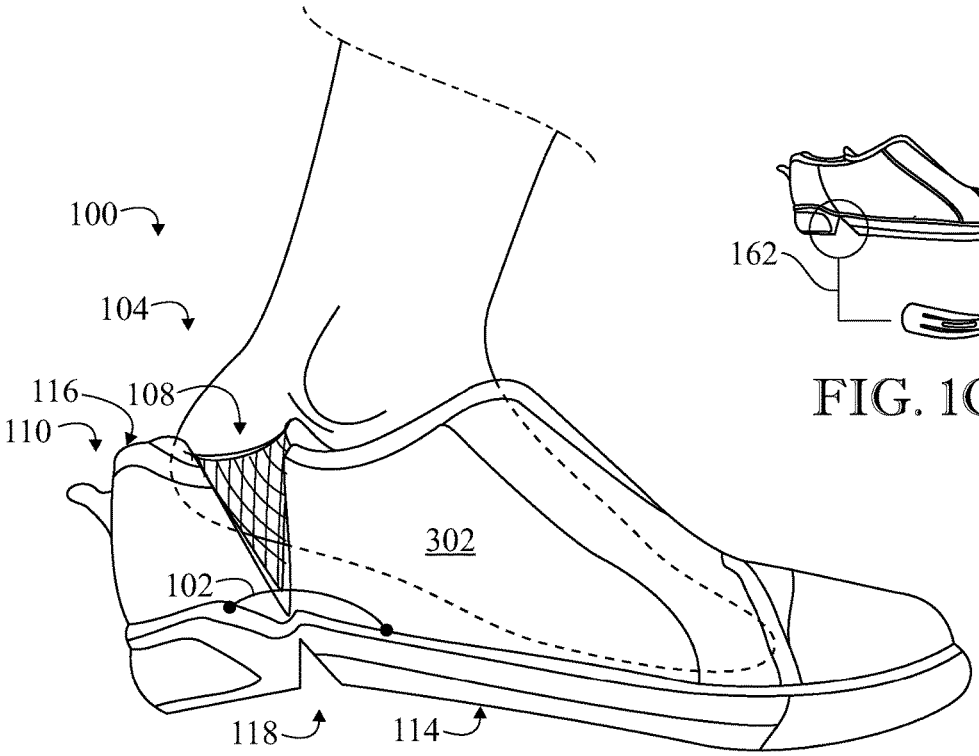
FIG. 1A presents a side view of an exemplary bimodal shoe including a bimodal clasp at a sole of the bimodal shoe, where the shoe is being donned, in accordance with aspects of the present disclosure.
Figure 3A:
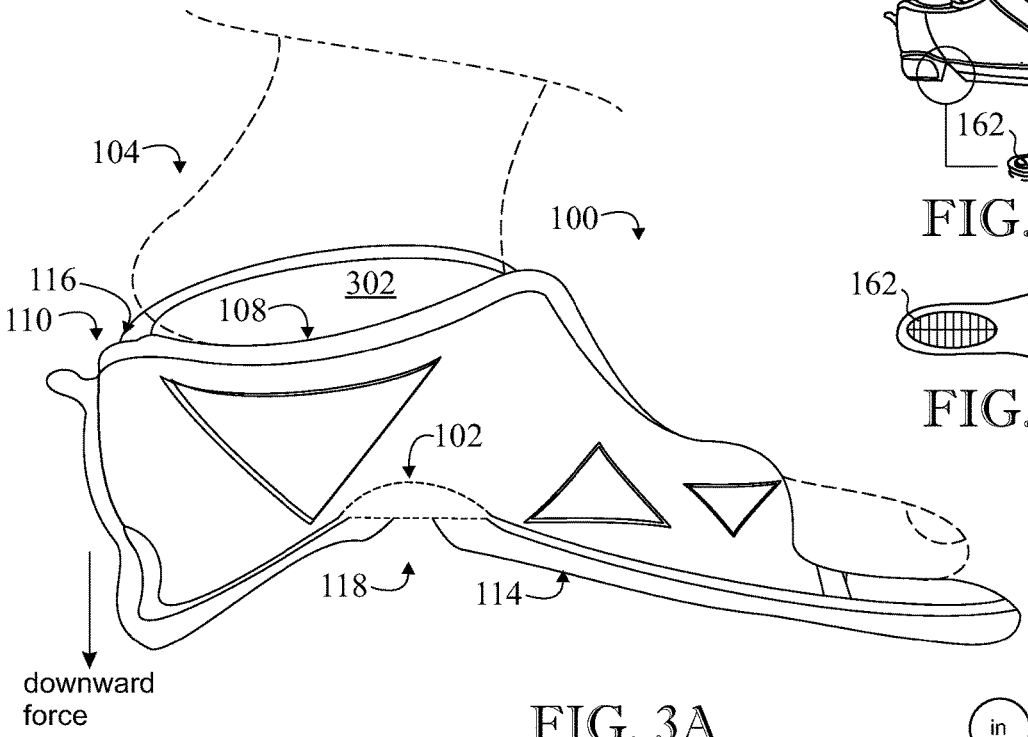
FIG. 3A presents a side view of an exemplary bimodal shoe including a bimodal spherical structure at a sole of the bimodal shoe, where the shoe is being donned, in accordance with aspects of the present disclosure.
Figure 3C:
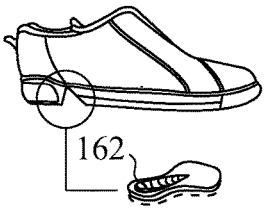
FIG. 3C presents a perspective view of a detached sole of the bimodal shoe, where the bimodal structure is incorporated into the sole having a curved three-dimensional profile or shape, in accordance with aspects of the present disclosure.
Figure 3D:
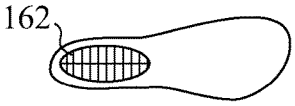
FIG. 3D a presents a top view of a detached sole of the bimodal shoe, where the bimodal structure is incorporated into the sole having a curved three-dimensional profile or shape, in accordance with aspects of the present disclosure.
Figure 5A:
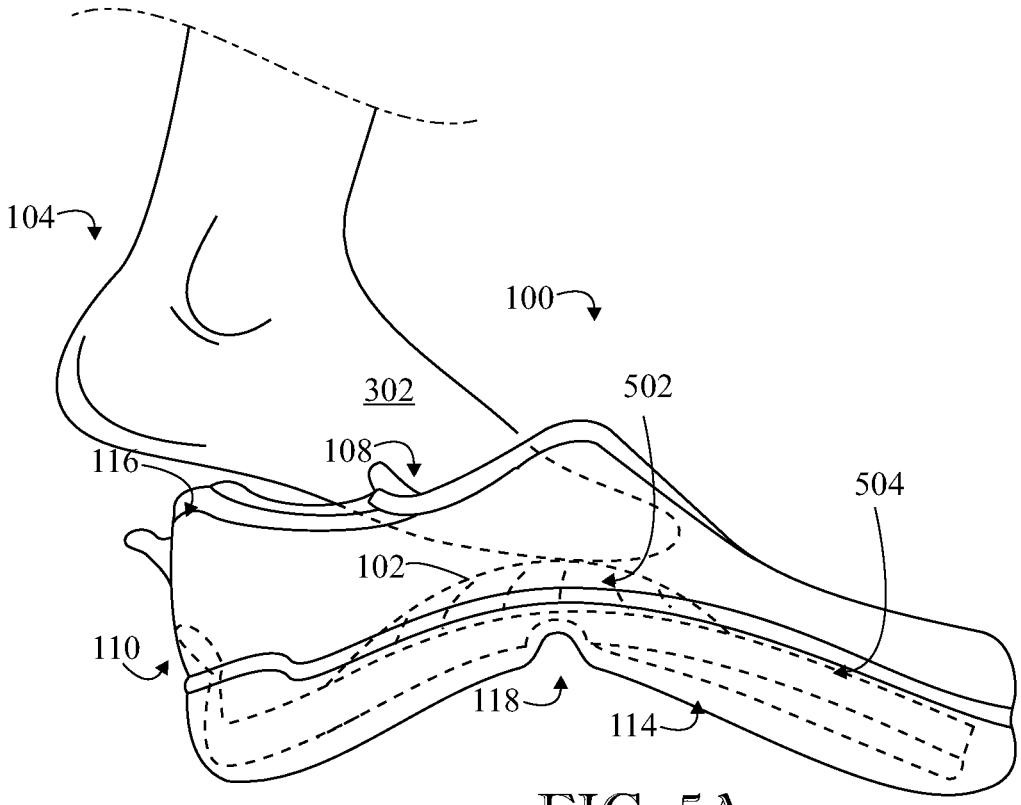
FIG. 5A presents a side view of an exemplary bimodal shoe including a bimodal dimple structure at sole of the bimodal shoe, where the shoe is being donned and the dimple adopts a first position, in accordance with aspects of the present disclosure.

In embodiments where the bimodal structure 102 is located at the sole, the sole may be configured to bend near a vicinity of the bimodal structure 102 such that the heel counter 110 pivots. For example, as shown throughout the figures, a notch 118 in the sole may help allow the sole to bend near a vicinity of the bimodal structure 102 and also can contain an area that can provide the focused upward pressure to activate the bimodal structure. A wearer may press their opposite foot to the back heel tab when the bimodal structure is in position 106, utilizing connected firm elements of the heel counter or sole as a general lever as represented by vector diagram 144 in FIG. 1B, causing the downward motion to rock the back heel and heel counter as a pivot point, with the sole area 118 causing upward pressure on the pressure sensitive area of the bimodal structure 102 to cause the bimodal shoe to snap into position 104, as shown in FIGS. 1A, 3A, and 5A. For example, such a heel tab may be a back portion of the bimodal structure 102 (e.g. clasp) that extends out from a heel of the shoe, as shown in FIG. 1E. However, as shown in ii), the bimodal structure (e.g. clasp) may be completely within the shoe.

In embodiments where the bimodal structure 102 is located to cause the heel counter 110 to deform; as shown in FIGS. 2A and 2B, and 4A-4C, the bimodal structure 102 may extend from or near the sole 114 to the upper portion 116 of the heel counter 110.

Figure 4C:
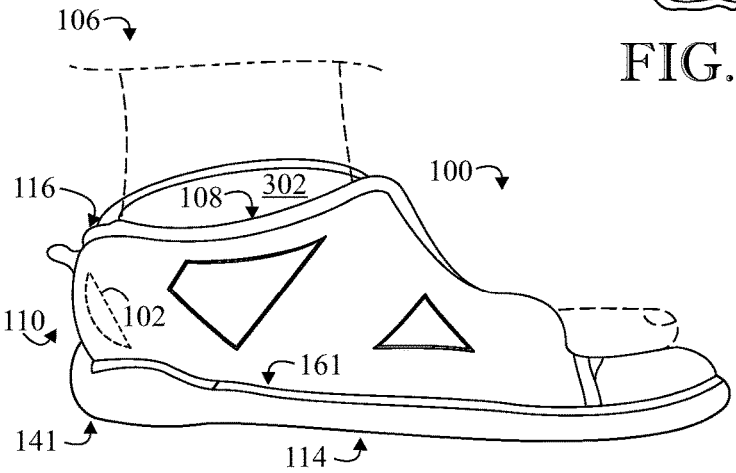
FIG. 4C presents a side view of an exemplary bimodal shoe including a bimodal spherical structure at the heel counter of the bimodal shoe, in accordance with aspects of the present disclosure with the detachable portion of the bimodal structure permitting the bimodal structure to deform upward, and further permitting the heel of the user to come down directly on the pressure point when the shoe is to be donned, in accordance with aspects of the present disclosure.

In embodiments where the bimodal structure 102 is located to cause e heel counter 110 to deform: as shown in FIG. 4C, the bimodal structure 102 may extend from or near the sole 114 to the upper portion 116 of the heel counter 110. The back portion of the rear heel collar 161 may be separated from the sole as to enable an upward or downward deformation when the bimodal structure is activated.

As shown in FIGS. 1A-1E, 2A, and 2B, the bimodal structure 102 may be a 3-point clasp or similar structure incorporated in the sole itself. For example, the clasp structure may be a three point clasp that snaps into the second position 106 and the first position 104 according to a transverse displacement of a central portion of the clasp. Displacing a central point of the clasp to relative to longitudinal ends of the clasp causes the clasp to snap into a position of stored mechanical energy due to its own mechanical and structural properties or geometry. This description and functionality appropriately may apply to any bimodal structure described herein.

Figure 1C:
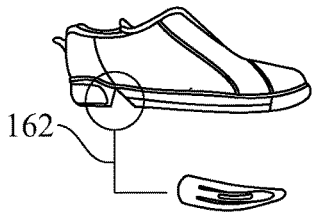
FIG. 1C presents a perspective view of a bimodal clasp separated from the shoe in accordance with aspects of the present disclosure.
Figure 1D:
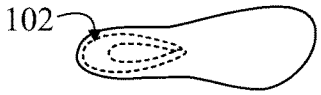
FIG. 1D presents bottom view of the bimodal clasp installed in the shoe, in accordance with aspects of the present disclosure.
Figure 1E:
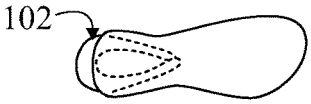
FIG. 1E presents a bottom view of the bimodal clasp installed in the shoe, where a back of the bimodal clasp extends out from a heel of the shoe as a heel tab, in accordance with aspects of the present disclosure.
Figure 3E:
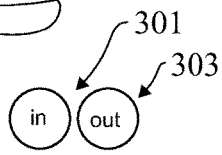
FIG. 3E shows the bimodal structure having a three-dimensional curved profile, in a first position and a second position, in accordance with aspects of the present disclosure.
Figure 3B:
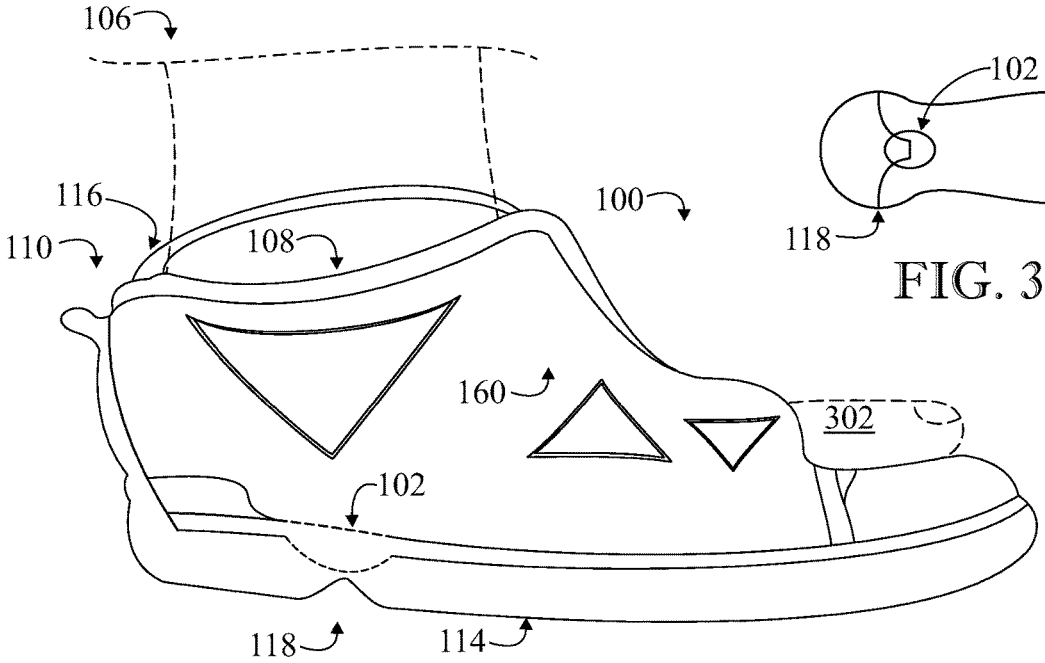
FIG. 3B presents a side view of the exemplary bimodal shoe of FIG. 3A, where the shoe has been donned, in accordance with aspects of the present disclosure.
Figure 3F:
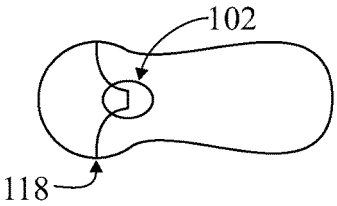
FIG. 3F shows a bottom view of the bimodal shoe having a three-dimensional curved bimodal structure configured for pivoting a heel counter of the bimodal shoe, in accordance with aspects of the present disclosure.

As shown in FIG. 1C, the clasp may include two bands 162 that are forced toward another in one of the second position 106 and the first position 104 (e.g. the bands may be spring biased with respect to one another according to displacement of a trigger or pressure point of the bimodal structure). The two bands 162 of the clasp are manufactured to have greatest stored tension at a midpoint between two operable positions, and thus may become forced to snap to one or the other rest positions, effecting the second position 106 or the first position 104. As shown in FIG. 2A, the bands 162 may be attached to an upper portion of the heel counter 110 such that the upper portion expands in two dimensions (e.g. back and forth and side to side) when the clasp is in the first position. Such bands may be applied to the configuration of the bimodal structure shown in FIG. 4G, where the bands separate when the concavity or curvature of the bimodal structure is reversed. For example, FIG. 3E shows the bimodal structure having a three-dimensional curved profile, in a first position 301 (e.g. popped in) and a second position 303 (e.g. popped out). 3F shows a bottom view of the bimodal shoe having a three-dimensional curved bimodal structure configured for pivoting a heel counter of the bimodal shoe.

As shown in FIGS. 3A-4C, the bimodal structure 102 may be semi-spherical, generally spherical, hemi-spherical, or partially spherical, in at least one of the second position 106 and the first position 104. For example, the spherical bimodal structure 102 may snap into the second position 106 and the first position 104 according to a transverse displacement of a central portion of the spherical bimodal structure 102 relative to ends of the bimodal structure 102. As shown in FIGS. 4A, 4B, 4C, and 4E the sole 114 may extend externally up to the middle portion 116 of the heel counter 110, forming back flared heel area 188 or back sole 141

(FIG. 4F) that rises upwards behind the heel counter, converting downward pressure on the back tab or shape into focused pressure to the singular pressure point that can activate the bimodal structure 102. A pressure point of the bimodal structure may be a point which displaces past a threshold distance with respect to edges or ends of the bimodal structure to cause the bimodal structure to snap into at least one of the first and second positions for donning or doffing the shoe, respectively. Such a pressure point may also be referred to as a trigger point or displacement point or inversion point. The pressure point may be a point of the bimodal structure that has a maximum displacement moving between the first and second positions.

Figure 1B:
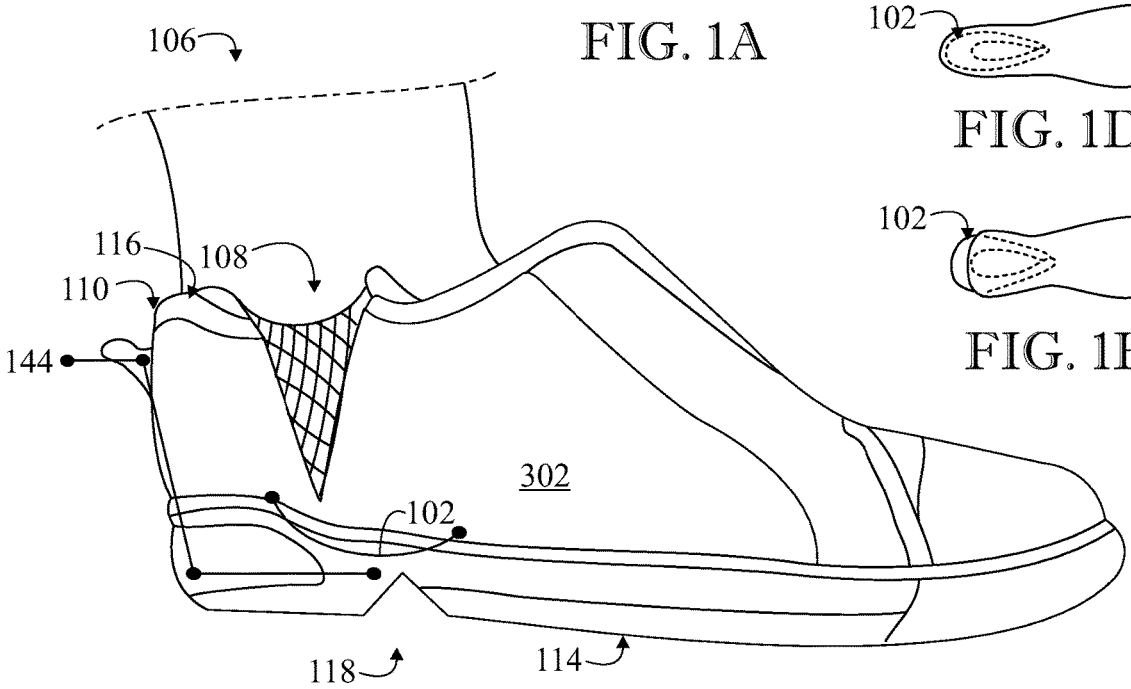
FIG. 1B presents a side view of the exemplary bimodal shoe of FIG. 1A, where the shoe has been donned, in accordance with aspects of the present disclosure.

As shown in FIG. 1B, in the second position 106, the bimodal structure 102 is curved downward such that an apex of the bimodal structure 102 is downwardly located with respect to a top of the bimodal shoe 100. Further as shown in FIG. 1A, in the first position 104, the bimodal structure 102 is curved upward such that an apex of the bimodal structure 102 is upwardly located with respect to a bottom of the bimodal shoe 100. As shown in FIG. 2A, a downward force on the upper portion 116 of the heel counter or heel tab 110 may cause the bimodal structure 102 to curve inwardly toward a front of the bimodal shoe, causing the bimodal structure 102 to adapt the first position 104. As shown in FIG. 1E, the bimodal structure 102 may also extend out of the heel forming the back heel tab itself.

As an example, the bimodal structure 102 may be curved in at least one of the second position 106 and the first position 104. Therefore, the bimodal structure 102 may be concave in at least one of the second position 106 and the first position 104. In another example, the bimodal structure 102 may he concave in one of the second position 106 and first position 104, and convex in another (e.g. opposite) one of the second position 106 and first position 104.

The bimodal structure 102 may be configured such that the bimodal structure 102 has a higher elastic potential energy stored as a result of being deformed to one of the second position 106 and the first position 104, and has a lower elastic potential energy in-between the second position 106 and the first position 104. In other words, the bimodal structure is a bendable structure that selectively snaps into the first position upon being subjected to a first bending force or displacement (e.g. at a pressure point), and that selectively snaps into the second position upon being subjected to a second bending force or displacement (e.g. at a pressure point), where the first bending force or displacement has an opposite direction to the second bending force or displacement. Therefore, in the second position 106 and first position 104 the bimodal structure 102 may be selectively locked into a stable and tensioned first or second position, while still holding its higher elastic potential energy. This configuration allows a user to overcome a threshold tension held by the bimodal structure 102 in the first or second positions to cause the bimodal structure 102 to move and subsequently selectively lock and snap into an opposite first or second position. For example, a user may simply press their foot into the shoe to snap the bimodal structure into the second position, and use their other foot to apply a downward lever-like force on a heel of the shoe while the shoe is already donned to cause the bimodal structure to snap out of the second position and/or snap into the first position (e.g. see FIGS. 2A and 2B). For example, a front of the user's foot may press against a top of the shoe opening, causing a general fulcrum point about a longitudinal center of the shoe, allowing the user to subsequently apply a lever force downwardly using their other foot on a heel of the shoe to cause the shoe to snap out of the second position. In other words, a front of a user's received foot (e.g. stepping on the ball of their foot, raising their own foot heel) applies an upward force (e.g. attempting to raise) to the shoe while the other foot can be used to snap the shoe out of the second position by applying a downward force onto the heel. For example, the bimodal structure is configured such that a net downward force applied to a heel counter of the bimodal shoe while the user's foot is received in the bimodal shoe, and while the user applies an upward force using a top of their foot by raising their heel and keeping the ball of their foot planted, causes the bimodal structure to snap out of the second position. Therefore, a net downward force (or displacement of) on the heel counter with respect forward, or other, portions of the shoe snaps the shoe out of the second position. In other words, holding frontal portions (or portions in front of a pivot point, or pressure point) of the shoe in place while applying a downward force on the heel causes the bimodal structure to snap out of the second position. A downward force applied to a heel counter of the bimodal shoe while holding portions of the shoe forward from the bimodal structure and away from the heel counter stationary causes the bimodal structure to snap out of the second position and into the first position. This allows the bimodal shoe to be doffed hands-free by snapping out of the second position.

As shown in FIGS. 1A, 1B, 1C, 3A, 3B, and 5A-5C, the bimodal structure 102 may be located at a sole 114, midsole, heel corner (FIG. 4G) (e.g. where the heel and the sole meet) or foot bed of the bimodal shoe 100, or a combination thereof. For example, the bimodal structure 102 may be located below a wearer's actual foot heel, or actual foot sole, such that the wearer's heel may apply force to the bimodal structure 102 when it is in the first position 104 to cause the bimodal structure 102 to lock into the second position 106 for donning the shoe hands-free.

Figure 2C:
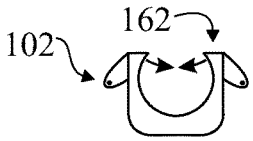
FIG. 2C presents exemplary side arms of a bimodal structure, in accordance with aspects of the present disclosure.
Figure 2C:
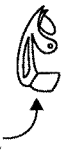
Figure 2B:
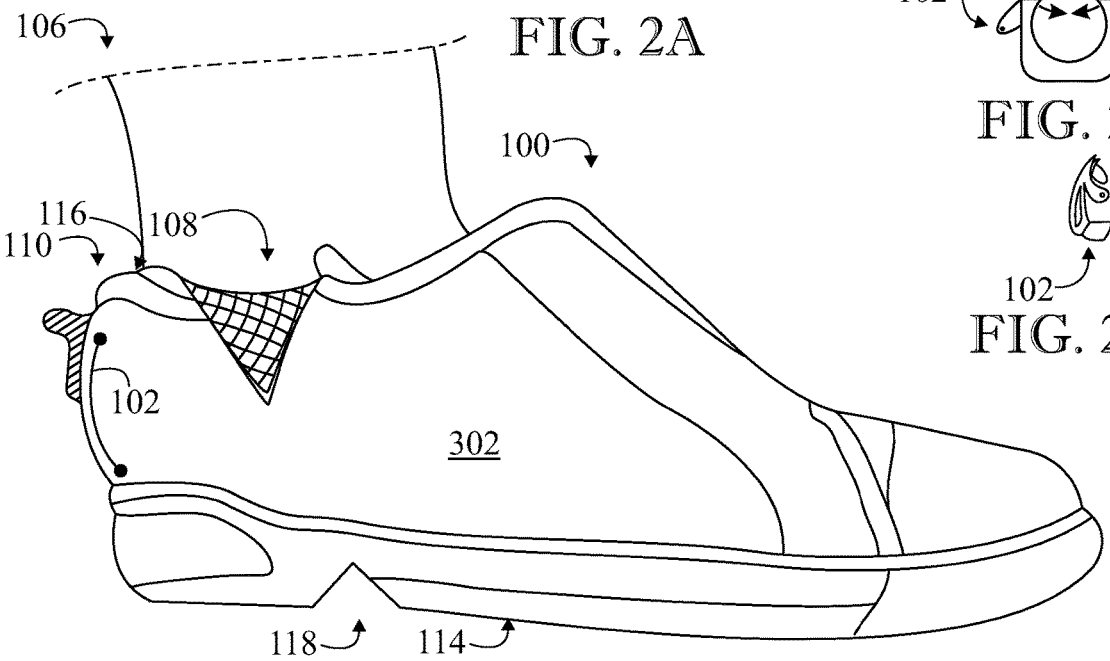
FIG. 2B presents a side view of the exemplary bimodal shoe of FIG. 2A, where the shoe has been donned, in accordance with aspects of the present disclosure.

As shown in FIGS. 2A, 2B, 4A, and 4B, 4C, the bimodal structure 102 may be located at a heel counter 110 of the bimodal shoe 100. As part of the heel counter 110, the bimodal structure may include a curvedly invertible portion and an upper portion. The upper portion may include two side bands 162 (FIG. 2C) that are attached to the opening 108 such that when the bimodal structure switches from the second position 106 to the first position 104 the arms of the bimodal structure 102 separate and cause the opening to become larger for receiving a foot. Additionally, the bimodal structure may be configured for the opposite to occur.

Figure 5B:
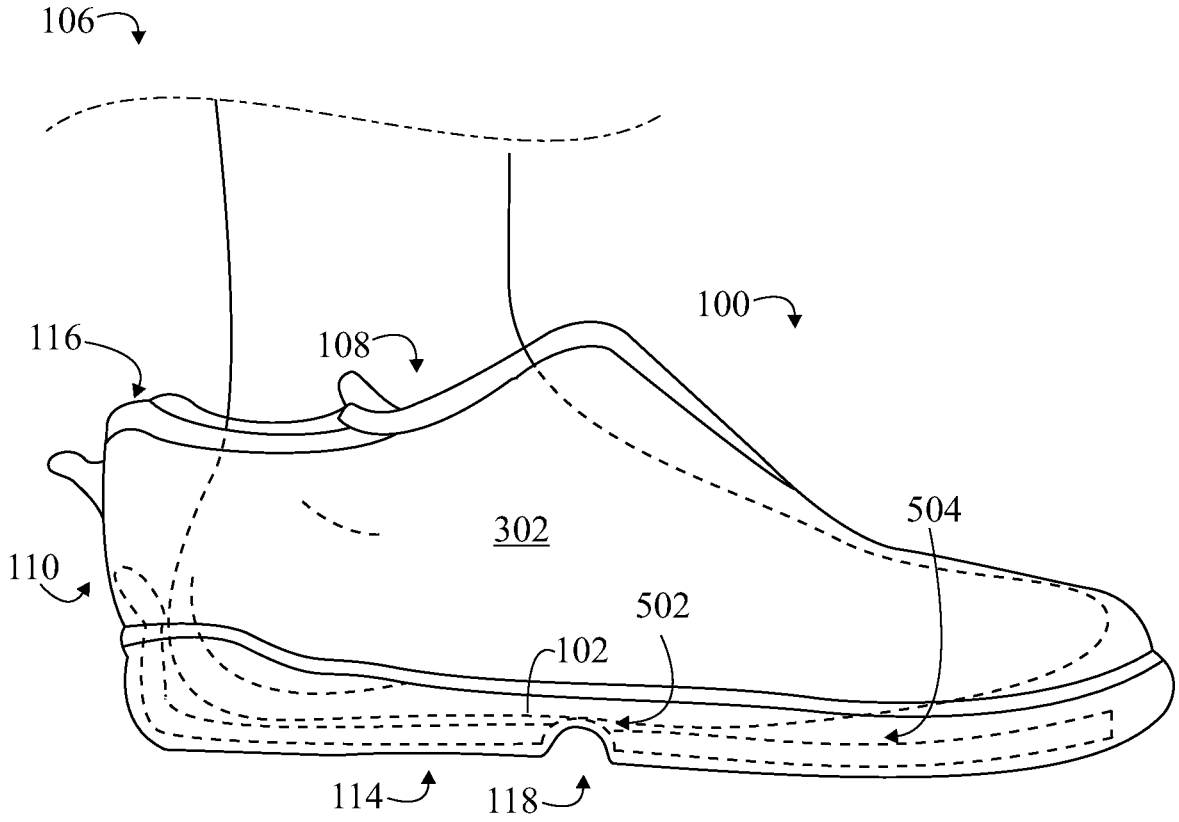
FIG. 5B presents a side view of the shoe of FIG. 5A, where the shoe has been donned and the dimple adopts as second position, in accordance with aspects of the present disclosure.
Figure 5C:
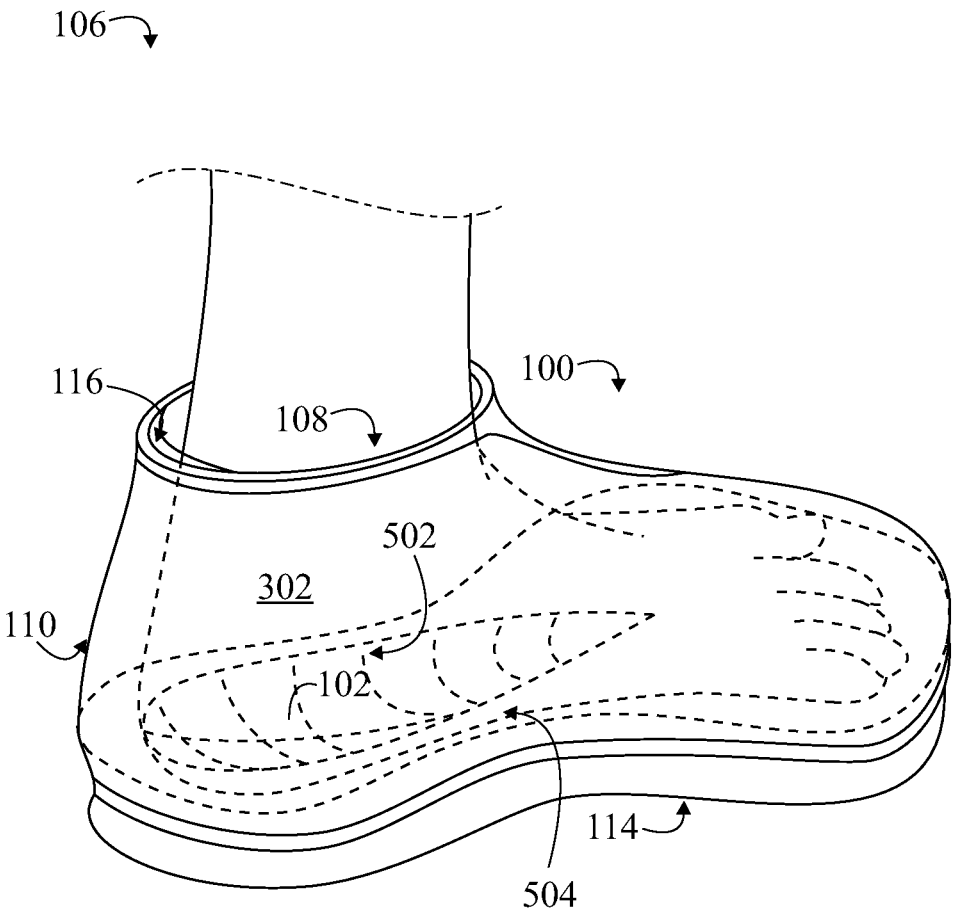
FIG. 5C presents a perspective view of the shoe of FIG. 5A, where the shoe has been donned and the dimple adopts the second position, in accordance with aspects of the present disclosure.

As shown in FIGS. 5A-5C, the bimodal structure 102 may be or include a dimple 502 that may have the some or all the same structural functionality as any of the bimodal structures described herein. The dimple 502 may be located at an internal portion 504 of a shoe's sole 506, as shown in FIG. 5C.

In conclusion, disclosed is a shoe that enables fast and easy placement and removal of shoes that is hands-free, and at the same time that permits structural support and gripping of the ankle thus permitting running and fast walking. When the user desires to remove the shoe the user may push down on their foot on the back of an opposite heel's tab to force the bimodal structure and/or the shoe to pop or lock open. This functionality may be provided by a snap clip or similar shape integrated into the sole or projecting from a back, with space between, such that upon being fastened together produces a slight twist bowing slightly in a direction transversely of a length of the sole or clip, causing the arms to flex to a concave-convex condition (selectively). Downward pressure of a user's foot heel entering the shoe may push the bowed ends back to a reverse concave-convex condition, to snap back into the non-inverted position. A semi sphere may have a similar ability to snap into either an inverted or non-inverted position upon receiving similar forces. It is to be understood that the bimodal shoe may include multiple bimodal structures described above in multiple locations, as appropriate.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should he determined by the appended claims and their legal equivalents.

What is claimed is:

1. A Shoe, comprising:

a sole structure; and an upper structure having an opening for inserting of a wearer's foot, the upper comprising a heel counter for surrounding a heel of the wearer's foot;

wherein the opening expands to a first opening at a first position when the heel counter is rotated rearwardly relative to a rear of the sole, and contracts to a second opening at a second position when the heel counter is rotated forwardly relative to the rear of the sole, the first opening is larger than the second opening to facilitate entry of the wearer's foot;

wherein the sole structure includes: a bimodal structure comprising a bendable clip having two ends and a central intermediate portion, the bendable clip has an upwardly concave configuration in a longitudinal direction of the sole structure when in the first position, and a second opposite downwardly convex configuration in the longitudinal direction of the sole structure when in the second position, wherein the bimodal structure is at rest in the first and second positions; and wherein the intermediate central portion of the clip is under greater stored tension than the ends so that upon applying a downward pressure from the foot, when the bimodal structure is in the first position will cause it to snap into the second position to secure the foot within the shoe.

2. The shoe of claim 1, wherein the sole structure includes a heel notch.

3. The shoe of claim 1, wherein the bimodal structure includes a heel tab extend out a back of the shoe.

* * * * *